United States Patent [19]

Mina

[11] 4,391,480

[45] Jul. 5, 1983

[54] ELECTRICAL TERMINAL

[75] Inventor: Nabil L. Mina, Roselle, Ill.

[73] Assignee: Appleton Electric Company, Chicago, Ill.

[21] Appl. No.: 205,884

[22] Filed: Nov. 10, 1980

[51] Int. Cl.[3] ..... H01R 27/00

[52] U.S. Cl. ..... 339/32 R; 339/123; 339/258 R

[58] Field of Search ..... 339/123, 32 R, 33, 258 R, 339/258 F, 258 P, 258 S

[56] References Cited

U.S. PATENT DOCUMENTS

| | | | |
|---|---|---|---|
| 1,508,474 | 9/1924 | Pollock | 339/33 |
| 1,628,399 | 5/1927 | Frankel | 339/123 X |
| 2,443,513 | 6/1948 | Quackenbush | 339/258 R X |
| 2,563,760 | 8/1951 | Uline | 339/258 R |
| 2,615,951 | 10/1952 | Klostermann | 339/258 R |
| 3,257,636 | 6/1966 | Van Horssen | 339/258 R X |
| 3,500,056 | 3/1970 | Riley | 339/32 M X |
| 4,213,018 | 7/1980 | Piston | 339/111 X |

*Primary Examiner*—Willie G. Abercrombie

*Attorney, Agent, or Firm*—Jon L. Liljequist

[57] ABSTRACT

An electrical terminal for a receptacle or other electrical connector and the method of making it. The terminal is preferably a cylindrical screw machine part cross-slotted at one end for receiving a male blade terminal therein in either of two angularly different orientations. When the terminal is used in a combination receptacle and switch, the other end of the terminal, the end opposite the cross-slotted end, may include an integrally formed switch contact for direct interaction with another and mating contact inside the switch portion of the receptacle.

1 Claim, 7 Drawing Figures

FIG. 4
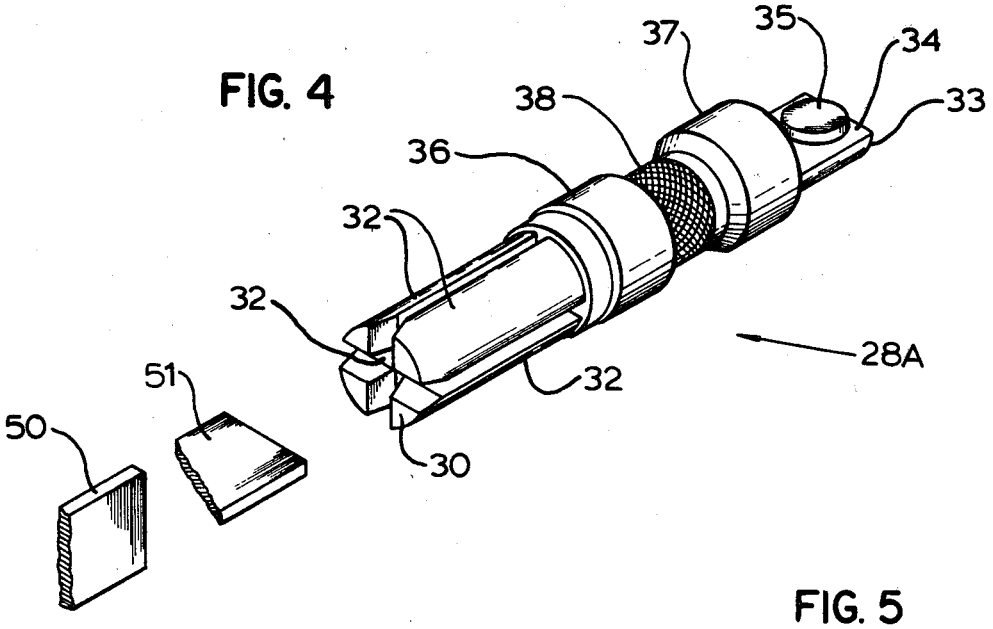
FIG. 5
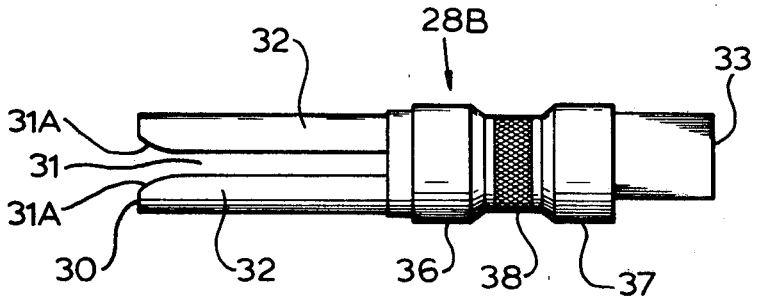
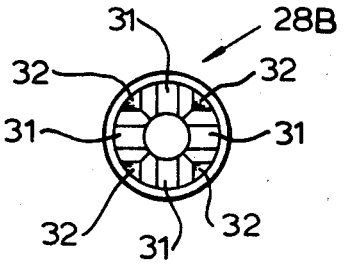
FIG. 6
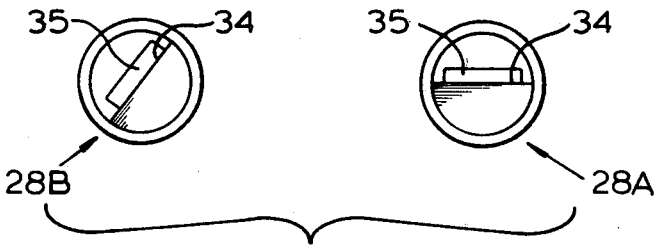
FIG. 7

ELECTRICAL TERMINAL

BACKGROUND OF THE INVENTION

The male and female contact portions of standardized electrical plugs and receptacles are designed to mate only when the design current and voltage for the plug are compatible with the design current and voltage for the receptacle. For example, most 125 volt a.c. household appliances in the United States incorporate plugs having a pair of parallel blade contacts that can be inserted through a pair of parallel slots in the insulating front faceplate of a wall receptacle. This is the standard design for 125 volt applications where current does not exceed 15 amperes. Where a heavier load of 20 amperes at 110 volts is needed, the blade contacts of the plug are perpendicular rather than parallel to one another. The insulating front faceplate on the receptacle for this plug similarly has perpendicular slots in it. Because a 20 ampere rated receptacle can accept any load under 20 amperes, some 20 ampere receptacles have insulating faceplates with "T" shaped slots therein capable of receiving the male blade contact configurations of both 15 ampere rated plugs and 20 ampere rated plugs. With these more universal designs, not only must the insulating front faceplate be capable of allowing either blade configuration to pass through it, but the female contact therebehind must also be capable of accepting one of the two male blade contacts in either of two perpendicular orientations. Female contacts with this capability have been known for a long time, but for the most part, they have been constructed of several pieces which are usually riveted together. These multiple piece, riveted assemblies are both expensive to manufacture and of poorer conductive characteristics than single piece terminals.

SUMMARY OF THE INVENTION

The female terminal of this disclosure is intended to be insert-molded in place within a receptacle body. Preferably it is machined from a single piece of raw material so as to have a female contact at its outer end capable of receiving a male blade contact in either of two mutually perpendicular orientations, and its other end may include a switch contact when the terminal is used in receptacle designs that also include a switch. With this latter combination contact-plus-switch design, the fact of its being made of a single piece means that there are no electrically resistive connections between the female receptacle terminal and the switch contact at its other end. Also, a piece of raw stock can be easily and quickly machined entirely on a multiple-spindle, automatic screw machine to have a female contact at one end with two-way male insertion capability and, if desired, a switch contact at the other end. Production of these improved terminals merely comprises properly setting up an appropriate automatic screw machine to machine the terminal's various diameters, cross-slotting one end, and then in certain desired instances, machining a flat contact surface on the other end. With a proper machine, a machine operator need only feed raw stock into the machine, and terminals with contacts on one or both ends as desired are ejected finished.

Single piece construction eliminates the possibility of a spark occuring between poorly assembled pieces, and this particularly important in explosionproof designs.

This same feature helps hold its operating temperature down also.

DESCRIPTION OF THE DRAWINGS

FIG. 4 is a three dimensional, perspective view showing a representative terminal according to the present invention, and also showing portions of a blade contact in two different orientations prior to insertion into the terminal.

FIG. 5 is a side elevation of one of the two terminals, specifically the one shown at the left in FIG. 3.

FIG. 6 is a front end view showing the female contact end of one of the terminals.

FIG. 7 is a rear end view of the two female terminals as mounted into the terminal block of FIG. 3, this view clarifying the orientation variation between opposite ends of the two terminals.

DESCRIPTION OF PREFERRED EMBODIMENT

Figure 1:
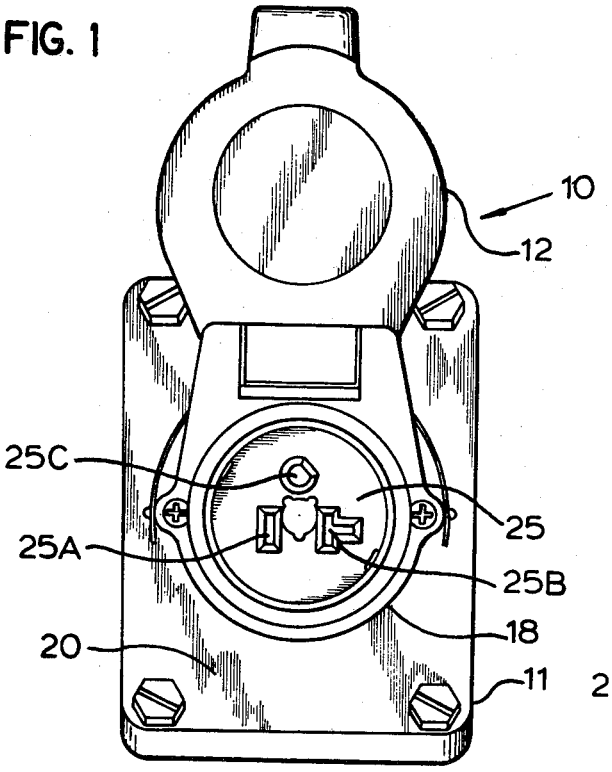
FIG. 1 is a front view of a combination switch and receptacle embodying the present invention, it being shown with its front cover open whereby its insulating faceplate is visible.
Figure 2:
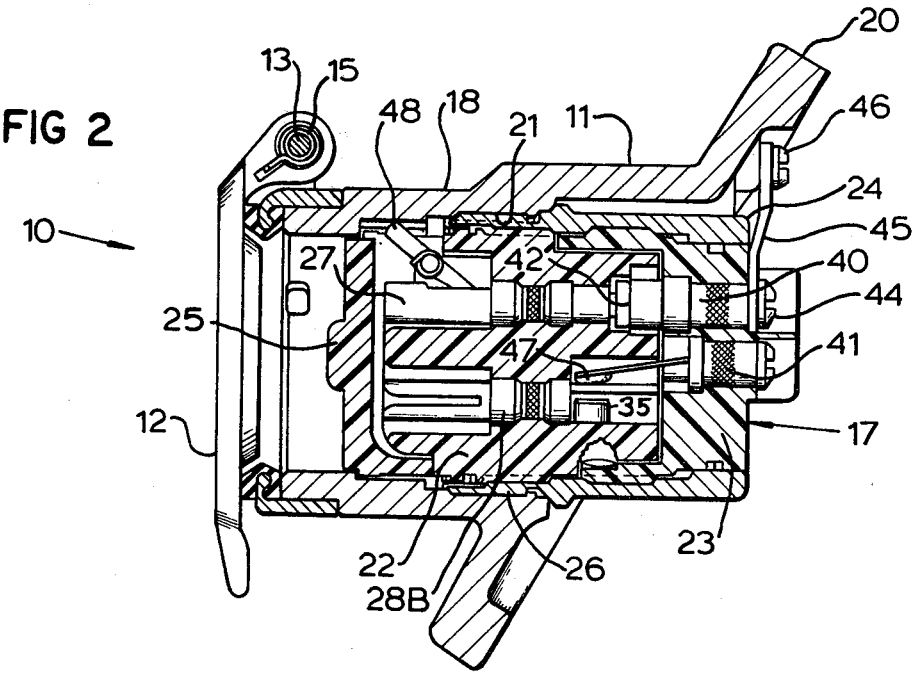
FIG. 2 is a side elevation in cross section of the combination switch and receptacle shown in FIG. 1, but with the cover closed.

Referring now to the drawings, and in particular to FIGS. 1 and 2, there is shown for illustration a 20 ampere, explosionproof, combination switch and receptacle generally 10 including a receptacle housing 11, a cover 12 hinged to the housing at 13 (and biased toward its closed position by a cover biasing spring 15), and also an externally threaded subassembly generally at 17 carried inside housing 11. Although the specific subject matter of this invention is contained within subassembly 17, a brief description of the entire receptacle 10 will be presented herein to clarify the invention's use in a practical application.

Receptacle housing 11 includes a tubular main body portion 18 and a mounting flange 20. Tubular portion 18 extends outwardly from the plane of flange 20 at an angle of approximately 60° so that when the flange is mounted vertically on a back box (not shown), the tubular portion slopes downwardly to avoid trapping and holding moisture or other contaminants therein. The inner surface of tubular portion 18 is partially threaded as at 21 so that externally threaded subassembly 17 can be screwed into the internally threaded tubular portion 18 from the flange end both to locate it properly therein and to create a threaded explosionproof barrier between the back box to which the receptacle 10 is mounted and the outer, surrounding environment.

Internal subassembly 17 houses the subject matter of this invention and includes a number of components including front terminal block 22, rear terminal block 23, an outer sleeve 24 comprises a thin walled tube carrying threads both internally and externally. Each of the terminal blocks 22 and 23 has an external thread thereon that mates with the internal thread inside sleeve 24. Subassembly 17 is assembled by axially aligning the two terminal blocks and, while holding them in contact with one another, screwing them a predetermined distance into the sleeve 24 from its front.

Rearwardly extending fingers on faceplate 25 that correspond to mating depressions in front terminal block 22 permit the faceplate to be snugly pressed onto the front face of terminal block 22 and held there in the proper orientation. As will be described more fully later, front terminal block 22 with faceplate 25 pressed thereon has some degree of rotational mobility relative to rear terminal block 23 and the sleeve 24 by virtue of its threaded engagement with sleeve 24. Faceplate 25 has three holes therethrough including an "I" shaped slot 25A, a "T" shaped slot 25B, and also a substantially round hole 25C. Slots 25A and 25B accept blade contacts therethrough, while hole 25C accepts a ground terminal. As will be appreciated, "T" shaped slot 25B will accept a male blade contact in either of two angular orientations 90° apart.

The forward, radially outermost surface of sleeve 24 is threaded as at 26 so that the entire subassembly 17 can screw into receptacle housing 11 as a unit. Once screwed snugly into place and locked therein, rear terminal block 23 and outer sleeve 24 are constrained against rotation, however as noted earlier, front terminal block 22 remains free to pivot through a small arc of perhaps 30° relative to rear terminal block 23, sleeve 24 and the rest of the receptacle by virtue of its loose threaded engagement with sleeve 24.

Figure 3:
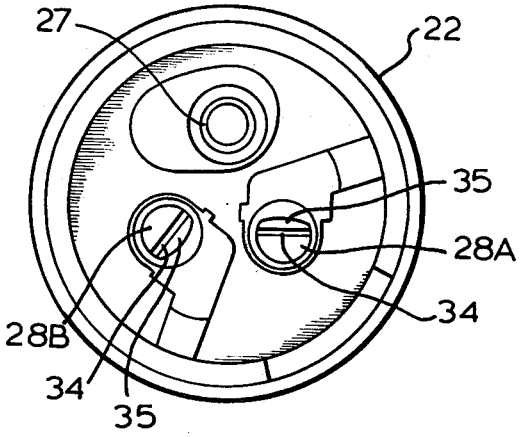
FIG. 3 is a rear view of an internal component within the combination switch and receptacle, and more specifically it is a rear elevation of the front terminal block.

Insert molded into front terminal block 22 (note both FIGS. 2 and 3) is a ground terminal 27 and a pair of female electrical terminals 28A and 28B. Ground terminal 27 lies directly behind hole 25C in the insulating faceplate, and electrical terminals 28A and 28B are aligned directly behind slots 25A and 25B, respectively.

Referring now to FIGS. 4–7, terminals 28A and 28B are preferrably machined, but they also could be sintered or otherwise formed from any electrically conductive material such as brass. The front or plug contact end 30 of terminals 28A and 28B have an outer cylindrical surface with a pair of longitudinally extending cross-slots 31 therein forming four longitudinally extending fingers 32. The forwardmost end of each of cross-slots 31 includes two radii 31A to facilitate insertion of the mating male blade contact. Preferably, the slots 31 are machined to the same width as the thickness of blade contacts 50, 51, and thereafter they are deformed slightly toward one another to provide a compressive contact force after the male blade is inserted therein. The other end 33 of terminal 28 is shaped to provide means for making an electrical connection with the electrical power source (not shown). Although these means could take a number of different forms, herein they comprise a switch contact. End 33 has a flat 34 formed thereon which could be used to act as the contact itself, or where a higher quality contact is required, a button shaped contact 35 of silver or the like can be bonded thereto by welding or by any other suitable means. Flat 34 of contact 28A is machined in the same plane as one of the slots 31 on the other end of that terminal, however it will be understood that flat 34 of contact 28B is machined at an approximately 45° angle relative to the slots 31 at the other end of the terminal.

Between contact surface 34 and contact fingers 32 of each terminal are two relatively large diameters 36 and 37 separated by a smaller diameter 38. The mold used to mold the front terminal block 22 has provision for insert-molding the terminals 28 therein so that they become captivated by and fixed relative to terminal block 22 in the molding process. The molded material surrounds surfaces 36–38, and the knurled and reduced diameter surface 38 prevents both rotation and translation of each of the terminals 28A and 28B relative to the molded block 22.

Rear receptacle block 23 is also insert molded, and specifically it has insert molded therein a fixed ground terminal 40 and a pair of fixed switch terminals 41 (only one being visible in FIG. 2). Spring biased internal structure (not fully shown) assures that continuity is maintained between ground terminal 27 and fixed ground terminal 40 even when front terminal block 22 is rotated back-and-forth by the limited angle of about 36°. A screw 44 in the rear of ground terminal 40 is tightened onto one end of a strap 45, and the other end of the strap is screwed as at 46 into receptacle housing flange 20 both to complete the ground connection as well as to lock rear receptacle block 23 against rotation relative to housing 11.

Fixed switch terminals 41 each include a forwardly extending switch contact 47 (only one being visible in FIG. 2) lying in the same transverse plane as button contacts 35, but they happen to be out of engagement in the orientation shown in FIG. 2. When a plug is inserted into the receptacle and rotated approximately 36° clockwise (as viewed in FIG. 1), both sets of contacts 35 and 47 engage one another and permit current flow to the electrical load.

In the particular explosionproof combination switch and receptacle shown, faceplate 25 and front terminal block 22 are prevented from rotating until the plug blade contacts are fully inserted into the receptacle contacts 28A and 28B. This is achieved by structure including a dog 48 that locks front terminal block 22 to housing 11 until the plug ground terminal is fully inserted into ground terminal 27 to thus trip the dog. Details of this safety mechanism can be found in U.S. Pat. No. 3,346,709 issued to Arthur I. Appleton.

It will be apparent that a 110 volt male blade contact oriented either as at 50 or as at 51 in FIG. 4 can be inserted through insulating faceplate 25 and into contact with terminal 28B. The plug's two blade contacts will engage both of terminals 28A and 28B regardless of whether it is rated for 15 or 20 amps. Radii 31A at the extreme forward end of perpendicular slots 31 ease the initial insertion of the male blade contacts and cause fingers 32 to spread slightly. It is not until after solid electrical contact is made between plug and receptacle that dog 48 is tripped permitting the front portions of internal sub-assembly 17, specifically faceplate 25 along with movable terminal block 22, to rotate. This rotation causes contacts 35 and 47 to engage one another and close the circuit. In this particular embodiment of the invention, contacts 35 and 47 happen to be contained within an exlosionproof chamber, thus preventing any explosion that might occur within the explosionproof chamber from propagating to the external environment.

Although the foregoing disclosure is detailed to insure adequacy and aid understanding, this is not intended to prejudice that purpose of a patent which is to cover each new inventive concept therein no matter how others may later disguise it by variations in form or additions or further improvements. The following claims are intended as the chief aid toward this purpose, as it is these that meet the requirement of pointing out the parts, improvements or combinations in which the inventive concepts are found.

I claim:

1. In combination with an explosionproof electrical receptacle and switch, said receptacle and switch including a faceplate with a first slot and a second slot therein, one of said slots arranged to receive a male blade contact in either of two mutually perpendicular orientations; an improved terminal block subassembly behind said faceplate and said one slot, comprising:

a terminal block having a front side and a rear side, an elongate and essentially singular piece of electrically conductive metal captivated partially within said terminal block and having a first end protruding from said terminal block front side and a second end protruding from said terminal block rear side, said first end being slotted longitudinally in two mutually perpendicular planes for receiving said male blade contact in either of said two orientations, said second end being a switch contact, and means between said first end and said second end for holding said terminal in said terminal block.

* * * * *